US008083076B2

(12) United States Patent
Hobbs et al.

(10) Patent No.: US 8,083,076 B2
(45) Date of Patent: Dec. 27, 2011

(54) PROTECTION APPARATUS, METHOD OF LOCATING A SUPERCONDUCTIVE MAGNET UNIT AND SUPERCONDUCTIVE MAGNET UNIT APPARATUS

(75) Inventors: Matthew Hobbs, Oxford (GB); Mark James Le Feuvre, Littlemore (GB); Nicholas Mann, Compton (GB); Philip Smith, Herzogenaurach (DE); Neil Charles Tigwell, Witney (GB); Frank Zeuch, Erlangen (DE)

(73) Assignees: Siemens PLC, Camberley (GB); Siemens Aktiengesellschaft, Munich (DE)

( * ) Notice: Subject to any disclaimer, the term of this patent is extended or adjusted under 35 U.S.C. 154(b) by 207 days.

(21) Appl. No.: 12/498,060

(22) Filed: Jul. 6, 2009

(65) Prior Publication Data

US 2011/0002111 A1 Jan. 6, 2011

(51) Int. Cl.
*A47F 7/00* (2006.01)

(52) U.S. Cl. ..... 211/26

(58) Field of Classification Search ..... 211/26, 211/26.2, 183, 70.6, 13.1, DIG. 1; 361/829, 361/141; 335/209, 220, 285, 284, 291; 248/364.01, 248/346.03, 363; 414/816; 254/1
See application file for complete search history.

(56) References Cited

U.S. PATENT DOCUMENTS

| | | | | |
|---|---|---|---|---|
| 2,674,370 | A | | 4/1950 | Iredell, III |
| 2,729,331 | A | * | 1/1956 | Norment et al. ..... 209/215 |
| 3,402,347 | A | * | 9/1968 | Nelson ..... 335/216 |
| 4,382,733 | A | | 5/1983 | Rodgers |
| 4,591,790 | A | | 5/1986 | Takahashi |
| 5,644,991 | A | | 7/1997 | Prévot et al. |
| 6,112,672 | A | | 9/2000 | Heil |
| 2005/0150194 | A1 | | 7/2005 | Okamuro |

FOREIGN PATENT DOCUMENTS

JP 2002255179 A 2/2001

* cited by examiner

*Primary Examiner* — Jennifer E. Novosad
(74) *Attorney, Agent, or Firm* — Schiff Hardin LLP

(57) ABSTRACT

A protection apparatus for a superconductive magnet unit has a support frame for location relative to a portion of the superconductive magnet unit. The support frame is arranged to carry a buffer for protecting the superconductive magnet unit from a shock load.

13 Claims, 6 Drawing Sheets

PROTECTION APPARATUS, METHOD OF LOCATING A SUPERCONDUCTIVE MAGNET UNIT AND SUPERCONDUCTIVE MAGNET UNIT APPARATUS

BACKGROUND OF THE INVENTION

1. Field of the Invention

The present invention relates to a protection apparatus of the type that, for example, is used to move a heavy object, such as a superconductive magnet unit. The present invention also relates to a method of locating a superconductive magnet unit of the type that, for example, requires manipulation of the superconductive magnet unit when deploying the magnet on a surface for use. The present invention further relates to a superconductive magnet unit apparatus of the type that, for example, comprises a housing for containing a superconductive magnet therein.

2. Description of the Prior Art

In the field of nuclear Magnetic Resonance Imaging (MRI) systems, it is necessary to transport component parts of an MRI system. One component is a superconductive magnet unit. The superconductive magnet unit is particularly heavy and due to the need to provide a cryogenic environment for a superconductive magnet forming part of the superconductive magnet unit, support systems that exhibit low heat conduction are used in the superconductive magnet unit. These support systems are susceptible to damage from shock loads and hence relatively fragile. In order to prevent the superconductive magnet unit becoming damaged, special precautions must be taken whilst handling the superconductive magnet during manufacture, subsequent transportation and installation at an end-user site.

During final stages of manufacture and test of the superconductive magnet unit, the superconductive magnet unit is typically handled by crane provided in a manufacturing facility. The use of cranes in the manufacturing facility requires expensive investment and careful operating procedures as well as other dedicated handling equipment. Sometimes, during manufacture, the superconductive magnet unit also needs to be transported between manufacturing sites, for example for assembly of additional parts of the MRI system, such as a gradient coil. In such cases, special precautions have to be taken to avoid damage to the superconductive magnet unit, for example through use of road trailers having wheel suspension systems capable of providing defined levels of shock attenuation.

Once finished, the MRI system then needs to be transported, possibly internationally, to the end-user site, for example a hospital. Transport can therefore be by commercial road, air and sea services, which are not under the control of the manufacturer of the superconductive magnet unit. Consequently, specially designed pallet systems employing tarpaulin covers are used that attenuate shock loads and provide protection from external causes of damage and atmospheric conditions. The specially designed "pallets" also require an interface frame located between the superconductive magnet unit and the pallet in order to facilitate engagement between the superconductive magnet unit and a pallet. However, the specially designed pallets are expensive to manufacture and add to the overall volume and mass to be transported. It therefore follows that use of the specially designed pallets constitutes an additional transportation cost, particularly when transportation is by air.

Upon arrival at the end-user site, the MRI system has to be installed, sometimes in environments where there is restricted access to the ultimate location for the MRI system. In such circumstances, specialized lifting, jacking and handling equipment are required, the specialized equipment typically needing to be ordered separately and shipped in addition to the MRI system to the end-user site and subsequently returned. Furthermore, during the installation process, no shock-protection is provided for the superconductive magnet unit and so there exists an increased risk of damage to the superconductive magnet unit.

The use of the precautions mentioned above in order to prevent damage to the superconductive magnet unit serves to increase the costs associated with providing the MRI system, particularly due to the duplication of handling equipment required and the need to provide return transportation for the handling equipment. Additionally, multiple transfers between the different handling systems mentioned above are time consuming, require temporary lifting equipment, and subject the superconductive magnet unit to additional risk of damage.

In any event, despite the use of different handling equipment at each stage, individually tailored to specific requirements, a small, but significant, number of superconductive magnet units are accidentally damaged, incurring re-working costs that are typically close to the value of the superconductive magnet unit. Additionally, availability of the completed MRI system is delayed.

SUMMARY OF THE INVENTION

According to a first aspect of the present invention, there is provided a protection apparatus for a superconductive magnet unit, the apparatus comprising: a support frame for locating relative to a portion of the superconductive magnet unit, the support frame being arranged to carry a buffer for protecting the superconductive magnet unit from a shock load. The apparatus comprises an elevation device.

The buffer may be a shock absorption device. The buffer may be a shock mount. The buffer may be formed from an elastomeric material, for example rubber.

The support frame may comprise a first part and a second part joinable at respective assembly points thereof. The support frame may be arranged to receive, when in use, an elevation device.

The elevation device may be a lift. The lift may be mechanical, pneumatic, or hydraulic. The lift may be a jack.

The support frame may be arranged to receive, when in use, a translation device.

The elevation device may be coupled to the translation device.

The translation device may be a roller device or wheeled device, for example a set of rollers. The translation device may have a brake.

The support frame may comprise an anchoring point for attachment thereto when lifting the superconductive magnet unit.

The support frame and/or the translation device may comprise an attachment point for coupling a drawbar thereto.

The apparatus may further comprise a post coupled to the support frame. The apparatus may further comprise a roof frame. The roof frame may be coupled to the post. The support frame, the post and the roof frame may be arranged as a collapsible structure.

The buffer may be capable of abutting, when in use, a complementary arrangement of a housing of the superconductive magnet unit.

According to a second aspect of the present invention, there is provided a method of locating a superconductive magnet unit on a surface, the method comprising: providing a support frame having an elevation device and arranged to carry a buffer for protecting the superconductive magnet unit from a shock load; locating the superconductive magnet unit relative to the support frame so that a portion of a housing of the superconductive magnet unit engages the buffer; actuating the elevation device in a first manner to elevate the support frame carrying the superconductive magnet unit in order to provide access to an underside of the superconductive magnet unit; performing a task in an access space provided beneath the underside of the superconductive magnet unit; actuating the elevation device in a second manner to lower the support frame.

The task may be in relation to the underside of the superconductive magnet unit. The task may be the attachment or detachment of a part in respect of the underside of the superconductive magnet unit. The part may be a vibration isolation device or a steadying device.

The method may further comprise: continuing to actuate the elevation device in the second manner so that the elevation device leaves the surface.

The method may further comprise: removing the support frame and/or the elevation device.

The method may further comprise: disassembling the support frame.

The method may further comprise: leveling the superconductive magnet unit, leveling comprising actuating the elevation device in order to facilitate provision of a leveling element beneath the superconductive magnet unit.

According to a third aspect of the present invention, there is provided a superconductive magnet unit apparatus, in combination with the protection apparatus of the invention. The superconductive magnet unit apparatus comprises a housing having a superconductive magnet located therein, and the housing has a complementary formation for engaging the buffer of the protection apparatus.

The housing may be arranged to define a substantially flat underside surface area for abutment with an isolation device when the housing is located on a surface for deployment.

It is thus possible to provide a protection apparatus that is simple, compact and sufficiently light for transportation within a manufacturing facility and during final installation. Furthermore, the protection apparatus is re-usable and capable of disassembly after installation, the disassembled protection apparatus being of a sufficiently compact size to minimize return transportation costs of the protection apparatus. The support frame can be easily removed after installation of, for example, the superconductive magnet unit, and the easy removal of the translation device facilitates final installation and leveling of, for example, the superconductive magnet unit. Consequently, protection is maintained during manufacture and up to delivery of the heavy load. Furthermore, the protection apparatus facilitates lifting thereof by a number of techniques. Also, time taken to install the load being transported is reduced.

At least one embodiment of the invention will now be described, by way of example only, with reference to the accompanying drawings, in which:

DESCRIPTION OF THE PREFERRED EMBODIMENTS

Figure 1:
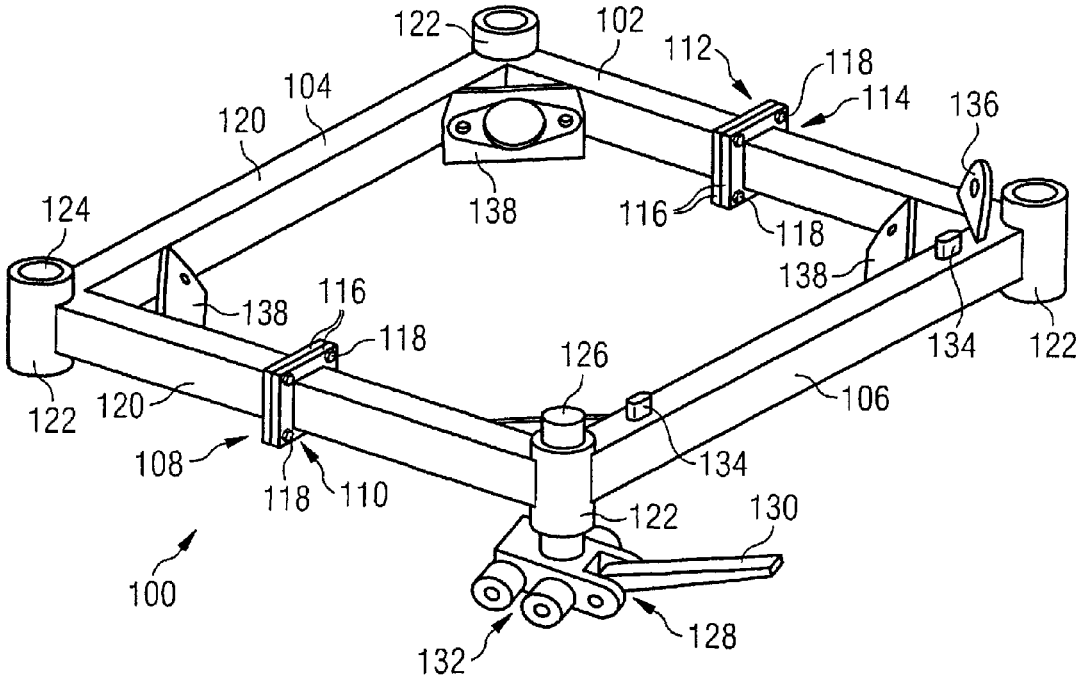
FIG. 1 is a perspective view of an apparatus constituting an embodiment of the invention.

Throughout the following description identical reference numerals will be used to identify like parts.

Referring to FIG. 1, a protection apparatus 100 for a load is provided that, in addition to protecting a load being carried, serves as a pallet by supporting the load and facilitating handling and transportation of the load. The protection apparatus 100 comprises a support frame 102 formed from a first frame part 104 and a second frame part 106. The first frame part 104 is connected to the second frame part 106 at two points: at a first assembly point 108 of the first frame part 104 and a first assembly point 110 of the second frame part 106, and at a second assembly point 112 of the first frame part 104 and a second assembly point 114 of the second frame part 106. In this example, the first frame part 104 and the second frame part 106 are bolted together at the first and second assembly points 108, 110, 112, 114 by abutting flanges 116 respectively carried by the first and second frame parts 104, 106 and having spaced apertures 118 formed therethrough.

When assembled, the first and second frame parts 104, 106 form a substantially rectangular frame, in this example a square-shaped frame. At each corner of the support frame 102, adjacent sides 120 of the support frame 102 are coupled to a respective tubular portion 122. Of course, each tubular portion 122 comprises an aperture 124, the aperture 124 being capable of receiving an elevation device 126 therethrough. In this example, the elevation device 126 is a jack, although the skilled person should appreciate that any suitable lift can be provided as the elevation device 126 and based upon any suitable operating principle, for example mechanical, pneumatic, or hydraulic. The elevation device 126 engages an underside of the respective tubular portion 122. Although not shown in this example, the elevation device 126 is coupled to a hydraulic pump mounted at a convenient point on the support frame 102. The hydraulic pump is also coupled to another one of the elevation devices 126, i.e. the hydraulic pump serves a pair of elevation devices. Consequently, in this example, another hydraulic pump (also not shown) is provided to serve the remaining two elevation devices 126. By providing pairs of independently controllable elevation devices 126, one end of the protection apparatus 100 can be raised or lowered independently of the other end of the protection apparatus 100. However, the skilled person should understand that, if desired, the elevation devices 126 can all be served by a single hydraulic pump or each of the elevation devices 126 can be served by respective individual hydraulic pumps. In this example, the hydraulic pump is a hand pump.

Furthermore, in this example, the elevation device 126 is combined with a translation device 132, for example a wheeled bogie 132, that carries the elevation device 126 for translation of the support frame 102 over a surface. In this example, the translation device 132 comprises a set of rollers, although the skilled person should appreciate that any suitable mechanism can be employed to provide translation over the surface, for example a set of wheels or a pneumatic device that uses downward expulsion of air to raise the support frame 102. A respective drawbar 130 for pushing and/or pulling the support frame 102 in different directions is coupled, at a pivot point 128, to each of a number of the translation devices 132. In order to provide maneuverability, each elevation device 126 is provided with suitable bearings to permit axial rotation thereof relative to the respective tubular portion 122. The translation device 132 optionally has a brake. Although the elevation device 126 and the translation device 132 have been described above in combination, the skilled person should appreciate that the elevation device 126 and the translation device 132 can be provided as separate entities. Furthermore, if desired, the elevation device 126 and/or the translation device 132 can be integrally formed with, or permanently attached to, the support frame 102.

As an alternative configuration, the set of wheels mentioned above can be replaced by casters (not shown) and the drawbars 130 can be respectively coupled to a pair of trunnions 134 provided on an upper surface of each side of the support frame 102 and serving as attachment points for the drawbars 130. In such a configuration, the elevation device 126 can be coupled separately from the casters to the support frame 102. Although pairs of attachments points 134 are described herein, the skilled person should appreciate that a greater or fewer number of attachment points 134 can be provided on one or more of the sides of the support frame 102. In this respect, one or more of the sides of the support frame 102 can comprise no attachment points 134.

An apertured plate portion 136 is provided at each corner of the support frame 102 to serve as a lifting and anchoring point.

At each corner of an inner periphery of the support frame 102, a buffer coupling plate 138 is provided. The buffer coupling plate 138 is formed so as to receive a buffer (not shown in FIG. 1) and located so that the buffers are oriented at a compound angle chosen to provide support and shock attenuation against accelerations in all directions so as to minimize the movement of the centre of gravity of the load being supported. In this example, the buffer is a shock mount formed from a block of rubber or other suitable material sandwiched between two steel plates, the shock mount being oriented towards the centre of gravity of the load. The rubber is used in compression and shear to provide a controlled movement under shock loads. However, the skilled person should appreciate that the buffer can be formed from any other suitable material, for example any other suitable elastomeric material. Similarly, the buffer need not be formed from an elastomeric material, but instead can be any other suitable shock absorption device, for example an at least part-mechanical arrangement can be employed, such as metallic springs and/or hydraulic dampers.

Figure 2:
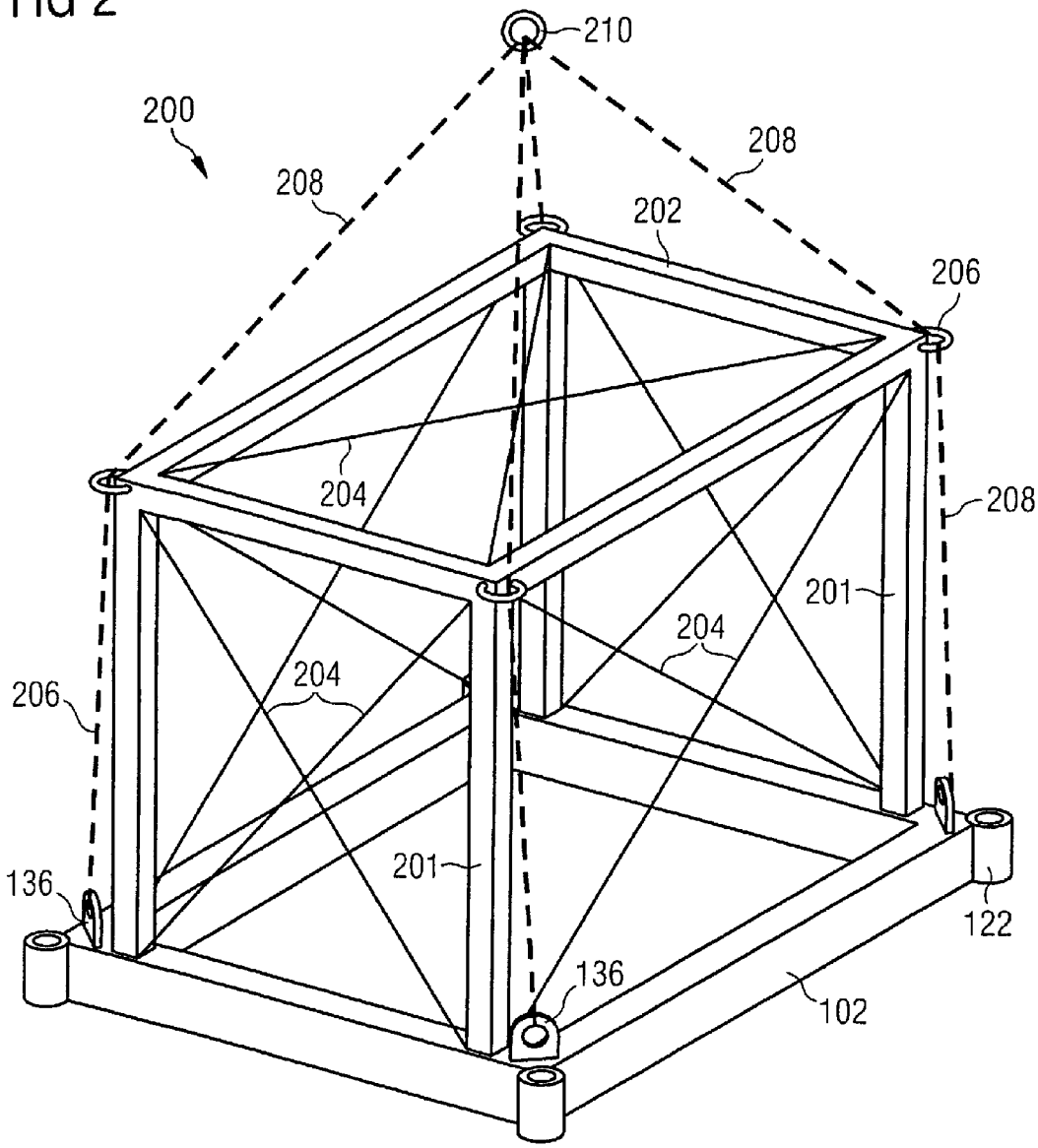
FIG. 2 is a perspective view of the apparatus of FIG. 1 having a surround frame coupled thereto.

Referring to FIG. 2, a surround frame 200 is provided by coupling corner posts 201 to the support frame 102 at corner mounting points. The corner posts 201 are coupled to a roof frame 202 at corners thereof, the corner posts 201 and the roof frame 202 being made rigid by the addition of tension members 204 running diagonally, for example so-called "lorry straps" each comprising a lashing and suitable tensioning device, such as a ratchet. The corner posts 201 extend longitudinally to a sufficient degree to enable the roof frame 202 to be spaced a sufficient distance from the support frame 102 so as to reside above an object to be transported by the protection apparatus 100, for example a superconductive magnet unit (not shown in FIG. 2). Guiding protrusions 206 comprising respective apertures are provided, for example at each corner of the roof frame 202, to guide lifting lines 208, for example chains, straps or other suitably strong connection means. In this example, the lifting lines 208 are coupled to a single lifting point 210 for lifting by a suitable lifting device. Removable covers, for example tarpaulins or rigid panels, can be placed over the protection apparatus 100, if desired, in order to protect the superconductive magnet unit 300 from atmospheric contaminants and mechanical damage.

In order to facilitate abutment of the support frame 102 with the load to be transported, the housing of the load to be transported is formed so as to provide complementary parts or areas for interaction with the protection apparatus. The complementary parts or areas for interaction serve as support points for the load to be transported. Although the embodiments described herein are applicable to many types of load or object requiring protection from external forces, for the sake or clarity and conciseness of description, embodiments of the invention will now be described in the context of manipulation and transportation of a superconductive magnet unit.

Figure 3:
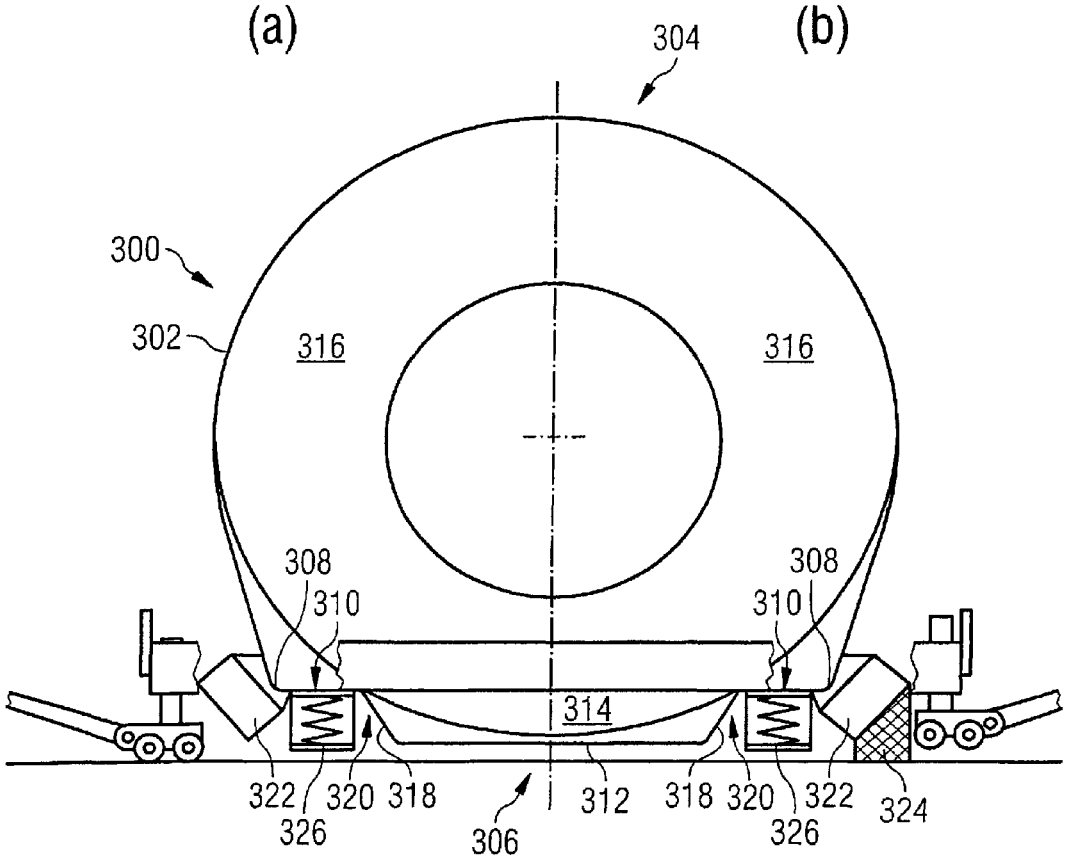
FIGS. 3(*a*) and (*b*) are schematic diagrams of the apparatus of FIG. 1 in two different states of use.

In this respect, and referring to FIG. 3, a superconductive magnet unit 300 comprises an outer housing, for example a so-called Outer Vacuum Chamber (OVC) 302. The OVC 302 comprises an upper region 304 and a lower region 306. In order to facilitate the interaction between the support frame 102 and the OVC 302 as described above, the lower region 306 of the OVC 302 is shaped so as to interface with the buffer 322 of the protection apparatus 100. To this end, the lower region 306 of the OVC 302 is provided with a shoulder portion 308 on each side thereof. In this example, the shoulder portion 308 is formed at each corner of the superconductive magnet unit 300.

In order to facilitate eventual location of the superconductive magnet unit 300 on a deployment surface (not shown), a respective substantially flat surface region 310 is provided adjacent the shoulder portions 308 at each corner of the OVC 302 before the OVC 302 defines a sump-like portion 312 in order to accommodate a lower portion 314 of a superconductive magnet 316 and other internal structural features of the superconductive magnet unit 300, the details of which are not relevant for the sake of describing the embodiments herein and so will not be described further. The substantially flat surface region 310 and a lateral side 318 of the sump-like portion 312 form a recess 320.

Figure 4:
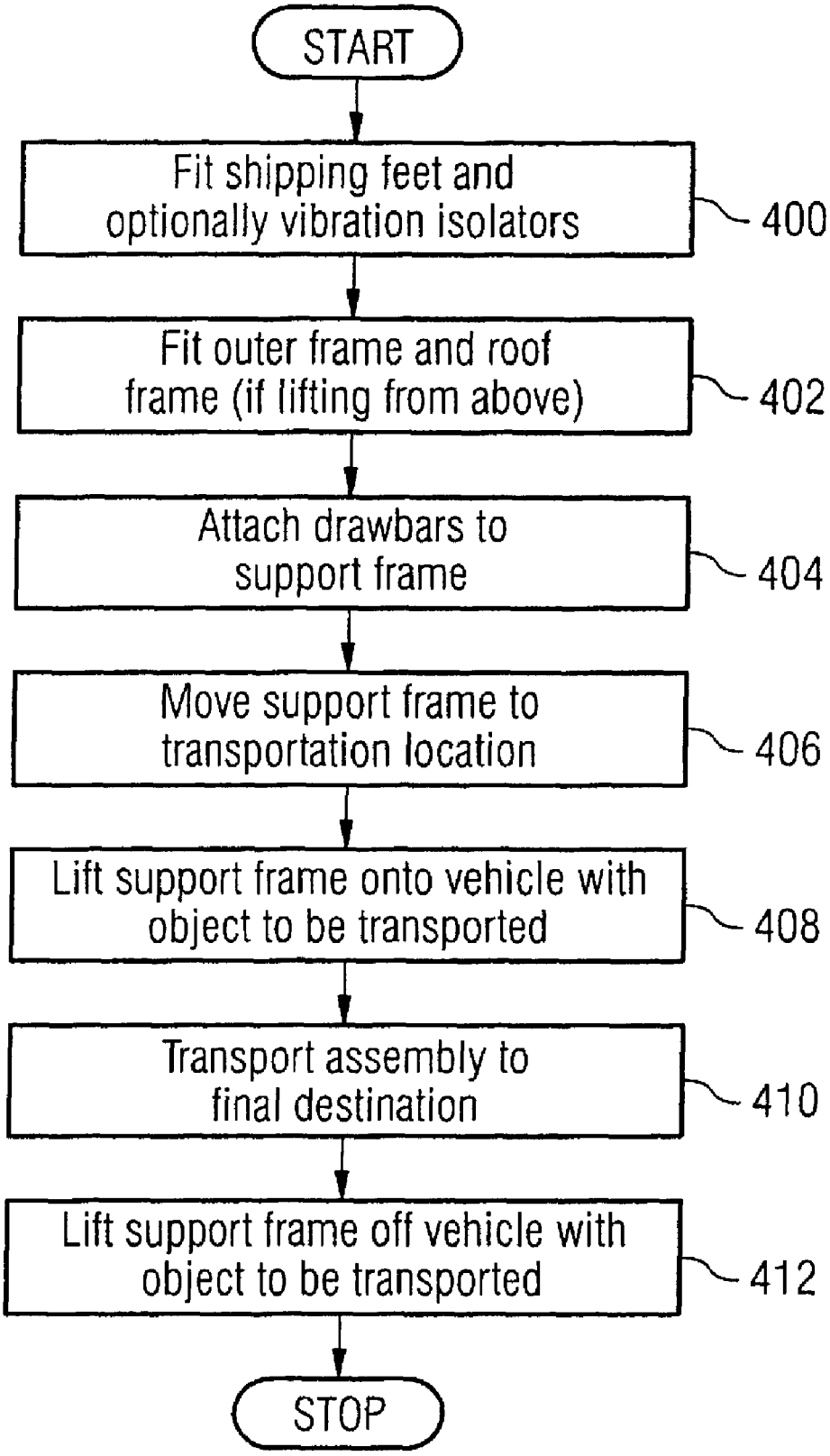
FIG. 4 is a flow diagram of a first method of locating an object using the apparatus of FIG. 1.

Operation of the protection apparatus 100 will now be described (FIG. 4) with respect to manufacture, transportation and installation of the superconductive magnet unit 300. In this respect, the superconductive magnet unit 300 is located within the support frame 102 so that the support frame 102 surrounds the lower portion 314 of the housing 302 of the superconductive magnet unit 300 at various stages of the manufacturing process. The buffers 322 abut the shoulder portion(s) 308 of the housing 302 and provide shock absorption for the superconductive magnet unit 300. The elevation device 126 is actuated in a first direction in order to elevate the support frame 102 and the superconductive magnet unit 300. As a consequence, the buffers 322 are also elevated. A so-called shipping foot 324 is then attached (Step 400) to an underside of each buffer 322, each shipping foot 324 having a complementarily shaped upper surface, for example, a sloped upper surface for abutment with the buffer 322, the buffer coupling plate 138, or the underside of the support frame 102. The shipping feet 324 can then be used to provide support when the superconductive magnet unit 300 is not being moved using the rollers. The shipping feet are substantially rigid blocks of material, for example steel, wood or aluminum, that serve to steady the support frame 102 when coupled between and in contact with the support frame 102 and a surface upon which the support frame 102 is standing.

If it is necessary to lift the superconductive magnet unit 300 from above or stop unwanted horizontal translation of the superconductive magnet unit 300, the elevation device 126 is actuated in a second direction in order to lower the support frame 102 onto the shipping feet 324, thereby bringing the respective sloped upper surfaces of the shipping feet 324 into abutment with the buffer 322 or the buffer coupling plate 138, thereby trapping the shipping feet 324 against a surface, for example a floor. The elevation device 126 can then be actuated further in the second direction so as to cause the translation devices 132 to raise from the floor. The support frame 102 is now supported in a stationary position and can have the surround frame 200 constructed (Step 402) around the superconductive magnet unit 300 by erection of the corner posts 201 and attachment of the roof frame 202 thereto. The tension members 204 are then fitted. The lifting lines 208 in the form of, for example, a sling or chains of a crane or other lifting device (not shown) available at a manufacturing facility, are attached to the apertured plate portions 136 via the guiding protrusions 206. The superconductive magnet unit 200 can then be lifted from above during manufacture whilst enjoying shock absorption protection provided by the protection apparatus 100.

Figure 5:
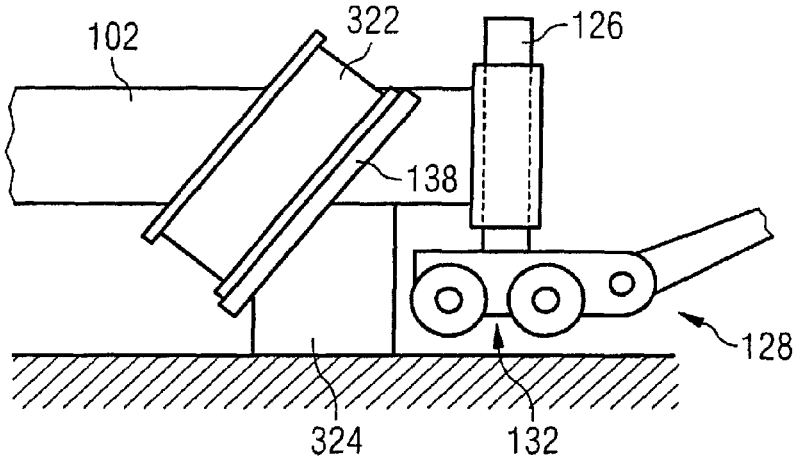
FIG. 5 is a side elevation of a part of the apparatus of FIG. 1.

When it is necessary to transport the superconductive magnet unit 200, for example between manufacturing facilities or to a deployment site, the support frame 102 can be raised using the elevation devices 206 until the shipping feet 324 are clear of the ground so that the support frame 102 is supported on the translation device 132. The drawbars (not shown) are then attached (Step 404) to the attachment points 134 or the translation devices 132, depending upon the precise configuration employed, and the superconductive magnet unit 300 on the support frame 102 drawn (Step 406) to a transportation location, for example adjacent a vehicle, such as a heavy-goods vehicle (not shown). The support frame 102 is then lowered back onto the shipping feet 324 using the elevation devices 126 and the translation devices 132 secured in respective retracted positions (FIG. 5). Using either an overhead lifting method or a fork-lift method, the support frame 102 carrying the superconductive magnet unit 300 is lifted (Step 408) onto the vehicle and secured, for example using the apertured plate portions 136

Figure 6:
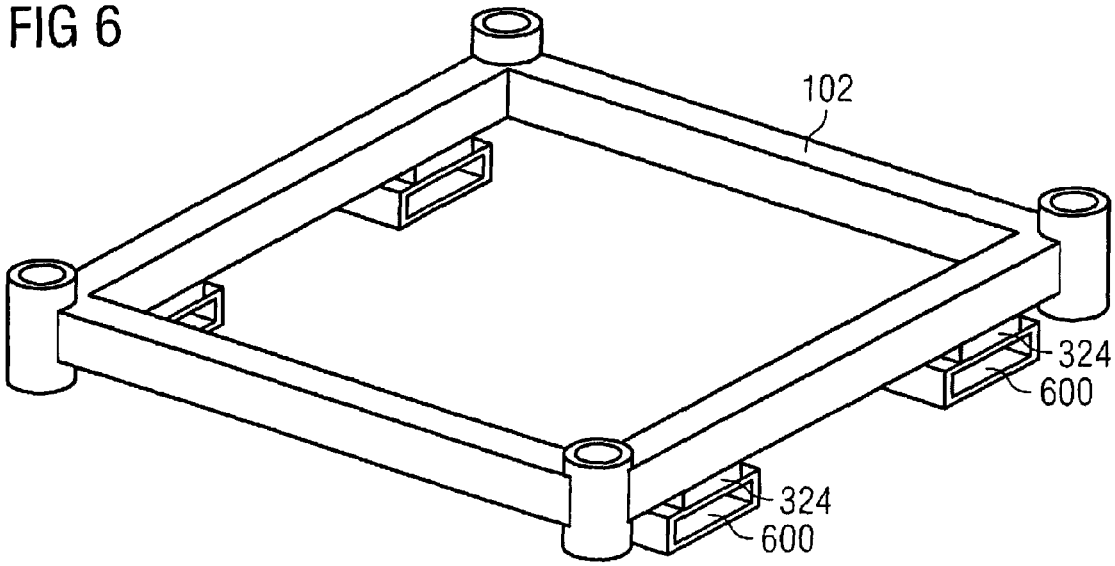
FIG. 6 is schematic diagram of a modification to the apparatus of FIG. 1 and constituting another embodiment of the invention.
Figure 7:
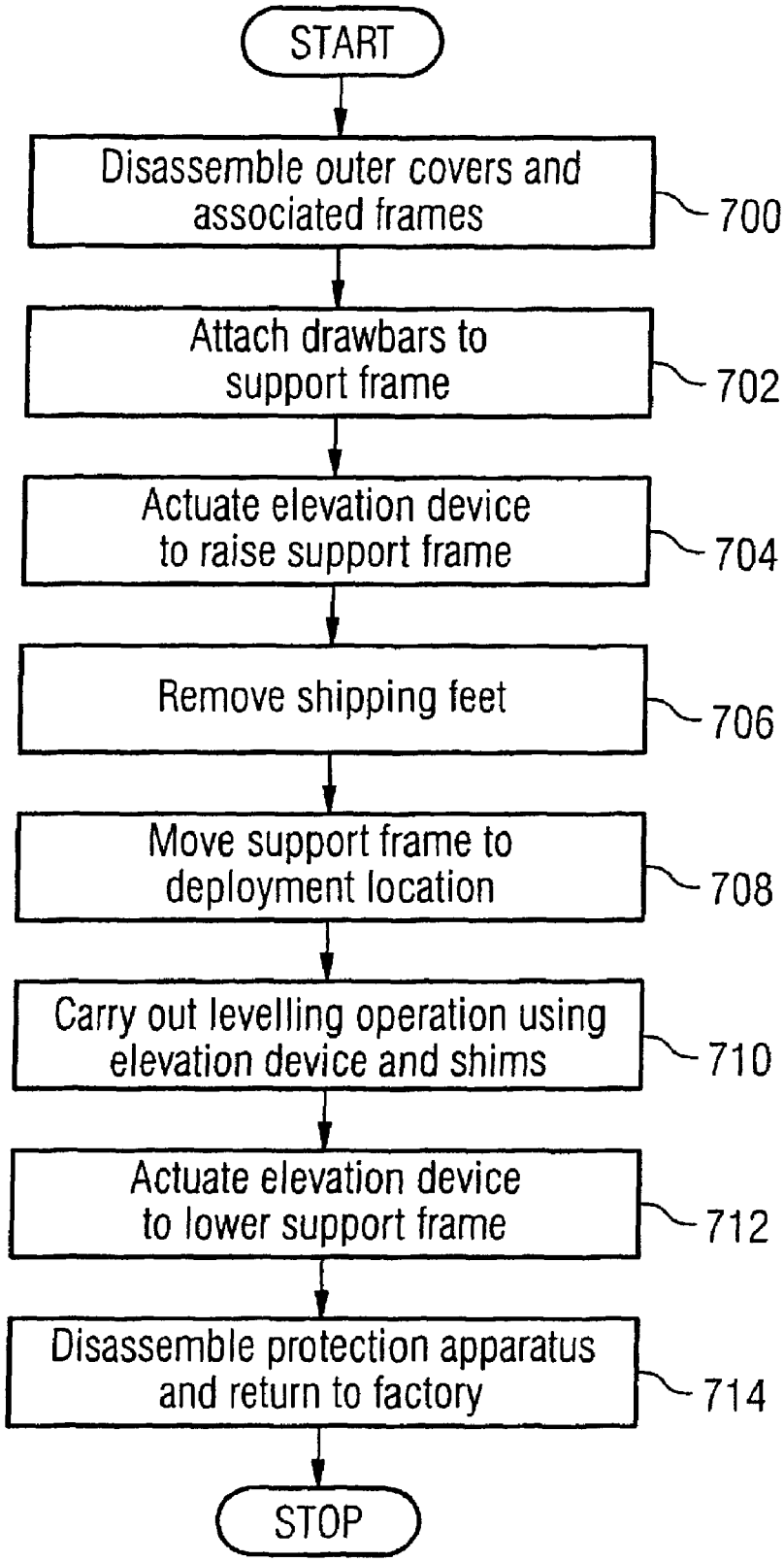
FIG. 7 is a flow diagram of a second method of locating an object using the apparatus of FIG. 1.

In this respect, and referring to FIG. 6, the shipping feet 324 can be provided with apertured, for example tubular, shoes 600 suitable to interface with forks of a fork-lift truck to allow lifting from below. Of course, provision of the surround frame 200 is still possible, though the facility for lifting from above does not necessarily have to be used.

The support frame 102, the surround frame 200 and the superconductive magnet unit 300 carried therein are then transported (Step 410) to a destination, for example a deployment site where, for example, a Magnetic Resonance Imaging (MRI) system is to be assembled. Once the vehicle has arrived at the destination for the superconductive magnet unit 300, the support frame 102 carrying the superconductive magnet unit 300 is unloaded from the vehicle (Step 412) by unloading the support frame 102 carrying the superconductive magnet unit 300 onto a suitably flat substantially smooth surface using the overhead lifting technique or the fork-lift technique as described above.

Turning to FIGS. 3(*a*) and 7, the covers are removed from over the surround frame 200 and the surround frame 200 is disassembled (Step 700). The drawbars 130 are then attached (Step 702) to the attachment points 134 or the translation devices 132, depending upon the precise configuration employed. The elevation devices 126 are then actuated (Step 704) in the first direction in order to bring the translation devices 132 into contact with the surface upon which the shipping feet 324 are sitting. Continued actuation of the elevation devices 126 in the first direction serve to raise the support frame 102 further and hence the raise the shipping feet 324 off the surface. The shipping feet are then removed (Step 706). The support frame 102 carrying the superconductive magnet unit 300 is then moved (Step 708) to a deployment surface (not shown) where the superconductive magnet unit 200 is, for example, to be used, such as a so-called MRI suite in a hospital. Movement of the support frame 102 and hence the superconductive magnet unit 300 to the deployment surface is by use of the translation device 132 in combination with the drawbars. Once the support frame 102 carrying the superconductive magnet unit 300 has arrived at a location to be used, permanent locating of the superconductive magnet unit 300 on the deployment surface has to take place.

If not already attached to the substantially flat surface region 310, vibration isolators 326, for example STOP-CHOCs™ available from Stop-choc, Slough, UK, are fitted to the substantially flat surface region 310 of the OVC 302. The vibration isolators serve to isolate the superconductive magnet unit 300 from undesirable vibrations emanating from the floor of the building and/or to isolate the building from vibrations generated by the superconductive magnet unit 300. The elevation device 126 is then actuated in the second direction in order to lower the superconductive magnet unit 300 and the vibration isolator 326 onto the deployment surface. During lowering of the superconductive magnet unit 300 and the vibration isolators 326, the superconductive magnet unit 300 is leveled (Step 710) in order to take account of any unevenness of the deployment surface which is commonly found in buildings. This is accomplished by lifting the superconductive magnet unit 300 and the vibrations isolators 326 where necessary and inserting spacers, sometimes known as "shims", between the mountings of the superconductive magnet unit 300, in this example the vibration isolators 326, and the deployment surface until the superconductive magnet unit 300 is leveled. Once leveling has been completed, the elevation devices 126 are finally elevated sufficiently to leave the superconductive magnet unit 300, the vibration isolators 326 and any shims in place (Step 712). Thereafter, the protection apparatus 100 is disassembled (Step 714), for example, by removal of the elevation devices 126 and the translation devices 132 and by disconnecting the first and second frame parts 104, 106 in order to form an efficiently dimensioned package for return shipping to the manufacturer or a supplier of the protection apparatus 100.

Although the vibration isolators 326 are described above as being fitted at the deployment site, the skilled person should appreciate that the vibration isolators 326 can be fitted at a factory during manufacture of the superconductive magnet unit 300, because in this example the shipping feet 324 are sufficiently tall to prevent the vibration isolators 326 from touching the ground.

As can be understood from the above-described examples, the support frame 102 can be raised to provide access to an underside of the load being carried. The access provided can be used to perform a number of tasks in relation to the underside of the load, for example attachment or detachment of the shipping feet 324 and/or attachment of the vibration isolators 326.

We claim as our invention:

1. A protection apparatus for a superconductive magnet unit, the apparatus comprising:

a support frame comprising a first part and a second part that are joinable to and separable from each other by disengageable connectors at respective assembly points of said first part and said second part, to configure said support frame to surround a superconductive magnet unit and to allow removal of the support frame from around the superconductive magnet unit, and to locate the support frame relative to a portion of the superconductive magnet unit;

said support frame carrying a buffer configured to protect the superconductive magnet unit from a shock load, said buffer being positioned on said support frame to abut a complimentary arrangement of a housing of the superconductive magnet unit when the support frame is configured to surround the superconductive magnet unit; and the support frame having elements configured to receive an elevation device that is operable to lift said support frame at said frame elements.

2. An apparatus as claimed in claim 1, further comprising an elevation device.

3. An apparatus as claimed in claim 1 wherein the support frame is configured to receive, when in use, a translation device.

4. An apparatus as claimed in claim 1, further comprising a translation device.

5. An apparatus as claimed in claim 4, wherein the elevation device is coupled to the translation device.

6. An apparatus as claimed in claim 4, wherein at least one of the support frame and the translation device comprises an attachment point configured to couple a drawbar thereto.

7. An apparatus as claimed in claim 1, wherein the buffer is a shock absorption device.

8. An apparatus as claimed in claim 1, wherein the buffer is a shock mount.

9. An apparatus as claimed in claim 1, wherein the support frame comprises an anchoring point for attachment thereto when lifting the superconductive magnet unit.

10. An apparatus as claimed in claim 1, further comprising a post coupled to the support frame.

11. An apparatus as claimed in claim 1, further comprising a roof frame.

12. An apparatus as claimed in claim 11 further comprising a post coupled to the support frame, and a roof frame coupled to the post.

13. An apparatus as claimed in claim 12, wherein the support frame, the post and the roof frame are arranged as a collapsible structure.

* * * * *